United States Patent [19]

Larsson

[11] 4,304,312

[45] Dec. 8, 1981

[54] PERCUSSION DRILL BIT HAVING CENTRALLY PROJECTING INSERT

[75] Inventor: Lars E. Larsson, Sandviken, Sweden

[73] Assignee: Sandvik Aktiebolag, Sandviken, Sweden

[21] Appl. No.: 111,307

[22] Filed: Jan. 11, 1980

[51] Int. Cl.[3] ..... E21B 13/08

[52] U.S. Cl. ..... 175/400; 175/410

[58] Field of Search ..... 175/400, 408, 410, 414, 175/417, 418, 389; 279/103, 96

[56] References Cited

U.S. PATENT DOCUMENTS

| | | | |
|---|---|---|---|
| 2,725,216 | 11/1955 | Brown | 175/417 |
| 2,759,705 | 8/1956 | Björkman | 175/389 |
| 3,004,767 | 10/1961 | Greene et al. | 279/103 |
| 3,100,545 | 8/1963 | Zimmerman | 175/410 |
| 3,185,228 | 5/1965 | Kelly, Jr. | 175/418 |
| 3,258,077 | 6/1966 | Phipps | 175/389 |
| 3,357,507 | 12/1967 | Stewart | 175/418 |
| 3,519,092 | 7/1970 | Miller | 175/410 |
| 3,800,892 | 4/1974 | Fischer | 175/418 |
| 3,997,011 | 12/1976 | Staroba | 175/400 |

*Primary Examiner*—James A. Leppink

*Attorney, Agent, or Firm*—Burns, Doane, Swecker & Mathis

[57] ABSTRACT

A percussion drill bit comprises a bit body including a shaft having a conical mounting portion to be mated with a conical mounting portion of a drill rod by means of substantially longitudinal friction forces. An annular row of circumferentially spaced button inserts extend from a front face of the body. A central button insert is disposed centrally of the other inserts and extends axially from the front face of the body beyond the other inserts to define a pilot insert. The outer inserts are inclined at an angle relative to the longitudinal axis of the body. A centrally located flushing channel is provided in the drill rod.

9 Claims, 4 Drawing Figures

PERCUSSION DRILL BIT HAVING CENTRALLY PROJECTING INSERT

This is a request for filing a continuation application under 37 C.F.R. 1.60, of pending application Ser. No. 854,752, filed on Nov. 25, 1977, now abandoned.

BACKGROUND AND OBJECTS OF THE INVENTION

The present invention relates to a drill bit, in particular for percussion drilling of smaller holes, comprising a bit body having button inserts at its front end forming in an outer row of circumferentially spaced inserts, the inserts of said outer row being disposed at an acute angle with the longitudinal axis of the bit.

Drill bits equipped with button shaped inserts instead of chisel shaped inserts have shown to result in a more suitable attack against the bottom of the drill hole, primarily because of the many attack points against the hole bottom occurring as a result of using button inserts. As a result thereof the drill bit is given a more calm running through the drill hole than compared with chisel bits, which decreases the strains exerted on the drilling equipment. Simultaneously more fine-grained drill cuttings, easy to flush away, will be achieved as a result thereof.

Heretofore, however, it has been technically possible only to use button bits for the drilling of larger holes in hard rock formations. The use of small dimensioned drill bits with button inserts has been limited to relatively loose rock formations, such as coal, schist, limestone and similar. The technical problems connected with the manufacture of button bits suitable only for hard rock formations have increased with decreased dimension of the drill bit. The primary reason for this has been that the percussive forces applied to the button inserts from the rear percussive rod are too vigorous for small button inserts leading to fracture of the inserts during drilling in hard rock formations. Fracture of button inserts in larger dimensioned drill bits also seem to be a result thereof.

In accordance with the present invention it has surprisingly been possible to provide a drill bit with button inserts with which the disadvantages of the aforementioned kind can be overcome. The drill bit of this invention is provided with a conically shaped shaft portion to be connected to a correspondingly shaped percussive rod portion, and said drill bit body is provided with a button insert at the centre of the front end.

It has been found that a frictional joint of conical shape between the bit body and the drill rod is able to substantially dampen the percussive forces exerted to the bit body from the rod which positively affects the strength of the button inserts. By providing simultaneously a central button insert, which preferably extends axially in front of the other inserts, a more favorable directing of the drill bit and, as a result thereof, more straight drill holes will be achievable. The strains will also be more favorably distributed between the centrally and peripherally located button inserts.

THE DRAWING

The invention will be described more in detail in the following detailed description taken with the accompanying drawings in which FIG. 1 is a side view of the bit body of the invention.

DETAILED DESCRIPTION OF PREFERRED EMBODIMENTS OF THE INVENTION

Figure 1:
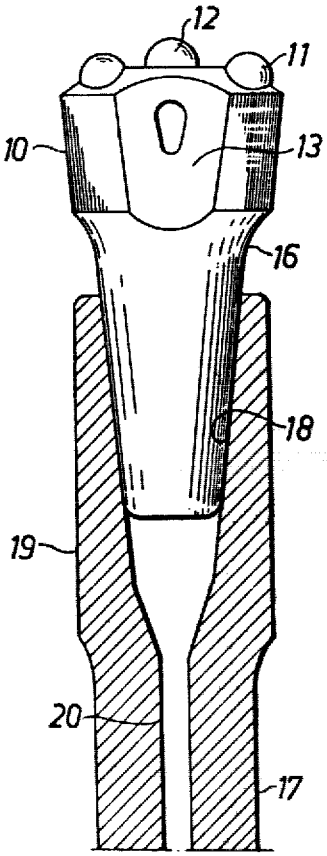

The drill bit of the invention comprises a bit body 10 which is symmetrically shaped about the drill axis. In the preferred and shown embodiment the front face of the bit body is substantially planar and provided with four button inserts 11 of cemented carbide spaced in an outer annular row at the front face of said bit body. The bit body is, in addition to the outer row of button inserts 11, equipped with a centrally located button insert 12 of cemented carbide. All button inserts are similarly shaped and have smoothly rounded outer end portions and all inserts are conventionally secured to said front face.

The central insert 12 should protrude axially from the front face of the bit body by substantially the same distance as the other button inserts 11. If the circumstances are such as to allow it, however, the central insert 12 could be located a small distance axially behind the other inserts 11.

The peripherally located inserts 11 are inclined at an acute angle with the longitudinal axis of the bit and suitably they extend from the front face of the bit at such an extent that the diameter of the drill hole is defined thereby. The mantle of bit body is provided with two parallel planar ground surface portions 13 at its periphery so as to provide for drill cuttings to be flushed rearwardly between these surface portions and the wall of the drill hole. The arrangement with a central insert results in a favorable limited variation in grain size which means that peripheral recesses are not necessary for effective flushing of drill cuttings. This is essential in small dimensioned drill bits because they require that every effort be taken to avoid any shape that could weaken the bit body.

The bit body 10 has a centrally provided flushing channel 14 and one or several branch channels 15 disposed at an angle to said first channel, said branch channels terminating at the peripheral surface portions 13.

The preferred embodiment shown comprises a bit body, the shaft portion 16 of which is exteriorly conical in shape for being frictionally connected to a drill rod 17 having a corresponding conical bore 18. The drill rod portion having said conical bore 18 consists of a portion 19 that is radially enlarged relative to the remaining portion of the drill rod 17. A centrally located flushing channel 20 is provided in the drill rod. Alternatively, the bit body 10 could be interiorly conical in shape for the receipt of an exteriorly conically shaped drill rod (not shown), if this is desirable.

Figure 2:
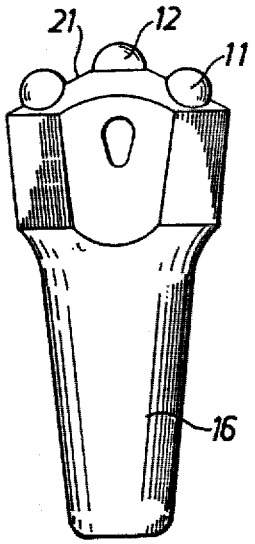
FIG. 2 is a side view of another embodiment of the bit body of the invention.

According to an alternative embodiment, shown in FIG. 2, the central portion 21 of the bit body protrudes beyond the peripheral portions thereof to such amount that the central button insert 12 extends axially beyond the other button inserts 11. An improved direction of the drilling operation has been found to b achievable as a result thereof which causes less strain to be exerted on the drilling equipment.

Figure 3:
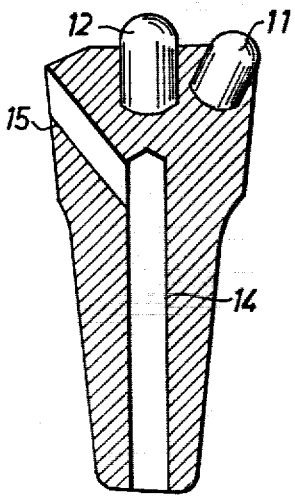
FIG. 3 is a longitudinal section view along the line III—III in FIG. 1.
Figure 4:
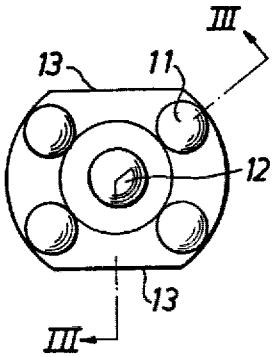
FIG. 4 is a front view of the bit body shown in FIG. 1.

The centrally provided button insert 12 should have a thickness at least equal to the thickness of the peripheral inserts 11 and preferably in excess thereof. At the same time the central insert 12 could be longer than the others so that it could be extend into the bit body further than the other inserts 11, as shown in FIG. 3, irrespectively of whether said central insert 12 extends from the front face by an amount equal to or in excess of the other inserts 11. In addition to this measure the wear strength of the central insert could be improved by using a type of cemented carbide for its fabrication, the strength of which is in excess of the strength of the carbide of the other inserts.

I claim:

1. A drill bit of the type to be mounted in a drill rod through which percussion forces are to be exerted for percussion drilling, said drill bit comprising:

a bit body defining a longitudinal axis and including a front face extending generally transversely relative to said axis, and a longitudinal mounting portion coaxial with said axis and having a conical surface for connection to a drill rod of corresponding conical shape by means of substantially longitudinal frictional forces;

a plurality of button inserts formed of cemented carbide, said inserts comprising:

a central insert extending forwardly outwardly of said front face in alignment with said longitudinal axis, and one annular circumferential row of outer inserts formed by all remaining ones of said inserts, said outer inserts being equidistantly spaced radially from said central insert, said outer inserts being arranged in pairs, the inserts of each said pair being diametrically opposed on opposite sides of said central insert and inclined at an acute angle relative to said longitudinal axis and define the outer diameter of the hole drilled by the drill bit, the outer end of said central insert extending longitudinally forwardly beyond the forward ends of said outer inserts to define a pilot insert.

2. Apparatus according to claim 1, wherein said front face includes a substantially planar central portion in the middle of which is disposed said central insert.

3. Apparatus according to claim 2, wherein said front face includes a beveled outer portion inclined at an acute angle relative to said longitudinal axis, said outer inserts being disposed on said beveled portion.

4. Apparatus according to claim 3, including at least one flushing channel extending through said bit body for conducting a flushing medium, said channel terminating radially outwardly and axially rearwardly of said central portion.

5. Apparatus according to claim 4, wherein said flushing channel further terminates axially rearwardly of said beveled portion.

6. A drill bit according to claim 1, wherein the thickness of said central insert is at least equal to that of the other inserts.

7. A drill bit according to claim 1, wherein said conical surface of said mounting portion comprises an external surface which is engageable with a conical internal surface of the drill rod.

8. A drill bit according to claim 1, wherein the length of said central insert is greater than that of said outer inserts and extends into the bit body a greater distance than said outer inserts.

9. A drill bit according to claim 1, wherein the entire outer end of each insert is smoothly curved.

* * * * *